United States Patent [19]

Chmielewski

[11] 4,445,470

[45] May 1, 1984

[54] OIL INJECTION WARNING SYSTEM

[75] Inventor: Cary J. Chmielewski, North Fond du Lac, Wis.

[73] Assignee: Brunswick Corporation, Skokie, Ill.

[21] Appl. No.: 453,652

[22] Filed: Dec. 27, 1982

[51] Int. Cl.[3] ..... F02B 77/08

[52] U.S. Cl. ..... 123/196 S; 123/198 D; 123/73 AD

[58] Field of Search ..... 123/196 S, 198 D, 198 DB, 123/198 DC, 73 AD

[56] References Cited

U.S. PATENT DOCUMENTS

| | | | |
|---|---|---|---|
| 2,838,039 | 6/1958 | Smith et al. | 123/196 S |
| 3,893,108 | 7/1975 | McBride, Jr. et al. | 123/198 D |
| 4,054,117 | 10/1977 | Palmer et al. | 123/198 D |
| 4,150,654 | 4/1979 | Heitzman et al. | 123/198 D |
| 4,292,939 | 10/1981 | Coates et al. | 123/198 D |
| 4,294,204 | 10/1981 | Hurner | 123/198 DB |
| 4,369,743 | 1/1983 | Holt et al. | 123/196 S |

*Primary Examiner*—Ira S. Lazarus

*Attorney, Agent, or Firm*—O. T. Sessions

[57] ABSTRACT

A two-cycle engine having an oil pump (19) driven by the engine crankshaft (11) to supply lubricant to the carburetor (12) has an alarm system to warn of an interruption of the oil pump drive. The alarm system has a signal processor (23) connected to activate an alarm (27) should signals from an oil pump rotation sensor (26) be interrupted, if a level switch (28) in the oil tank (20) indicates a low oil level, or should a signal from the ignition system (14) be interrupted. The signal processor (23) is also connected to briefly activate the alarm (27) when the engine is started to provide a test of the alarm system.

10 Claims, 2 Drawing Figures

OIL INJECTION WARNING SYSTEM

DESCRIPTION

1. Technical Field

This invention relates to two-cycle engines and particularly to such engines having an oil injection system for supplying oil to lubricate the engine.

2. Background Art

Two-cycle engines using a mechanically driven oil pump to supply oil for lubricating the engine are known. Such engines avoid the necessity of mixing oil with fuel and allow metering of the oil to supply an amount of oil appropriate to different operating conditions. Failure of such oil supply systems, however, can result in damage to the engine.

DISCLOSURE OF INVENTION

An alarm system for a two-cycle internal combustion engine which uses a mechanically driven oil pump to provide oil from an oil reservoir to lubricate the engine. The alarm system senses the speed of operation of the oil pump and of the engine and activates an alarm if the engine and pump speeds differ from a predetermined relationship. Thus the system will produce an alarm if the pump drive fails.

Preferably the system is arranged to produce an alarm for a brief period when the engine is started to indicate that the alarm system is functioning correctly. The system can be arranged to provide a continually operating alarm, once activated, until the engine is turned off.

Preferably the system also includes an oil level sensor to activate the alarm when the oil level in the reservoir is low.

In the preferred embodiment the alarm system uses a sequential logic circuit to process pulse type signals from the sensors. A rotation sensor for the oil pump shaft can use a magnet mounted on the shaft and a Hall switch to produce a pulse for each revolution of the shaft while the engine speed sensor can use an existing engine circuit, such as an ignition circuit, to produce a pulse for each revolution of the engine.

BEST MODE FOR CARRYING OUT THE INVENTION

Figure 1:
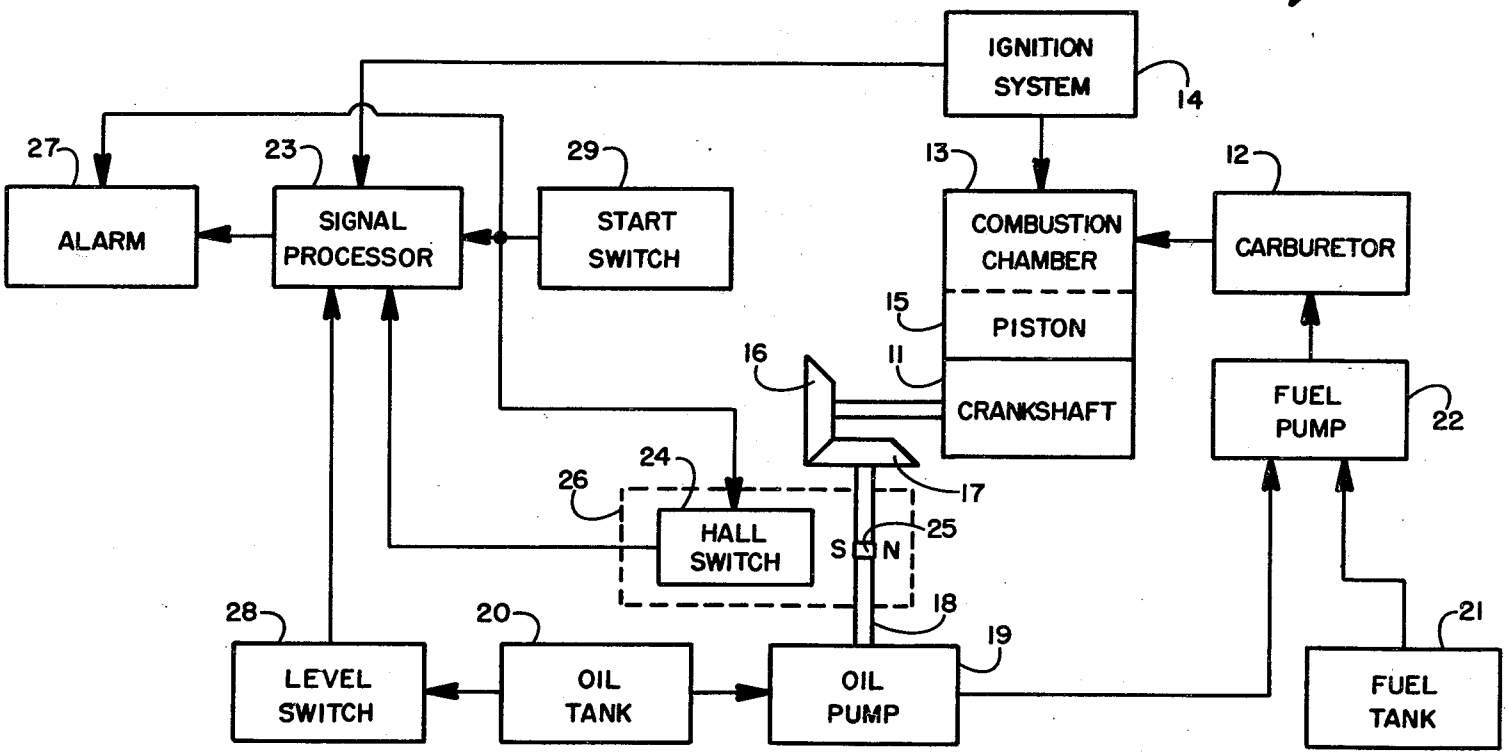
FIG. 1 is a block diagram of an alarm system as used on a two-cycle internal combustion engine using oil injection.

FIG. 1 shows a block diagram of a two-cycle engine system 10 intended to drive a crankshaft 11 to produce power. The engine illustrated includes a carburetor 12 to supply a air-fuel-oil mixture to the combustion chamber 13 where it is ignited by an ignition system 14 to drive a piston 15 which, in turn, is connected to drive the crankshaft 11. A gear 16 is mounted on the crankshaft 11 to drive a gear 17 connected by a pump shaft 18 to drive an oil pump 19. The oil pump 19 is connected to supply oil from an oil tank 20 to mix with the fuel supplied from a fuel tank 21, by a fuel pump 22, to the carburetor 12. The oil pump 19 is illustrated as having its outlet connected to the inlet of the fuel pump 22, though it could be connected to supply the oil to the outlet of the fuel pump 22.

The invention provides an alarm system having a signal processor 23 areceiving signals from the ignition system 14 indicative of the speed of the engine and signals from a Hall switch 24 mounted adjacent to the pump shaft 18. A magnet 25 is mounted on the pump shaft 18 aligned with the Hall switch 24. The magnet 25 and the Hall switch 24 act as a rotation sensor 26 by causing the Hall switch 24 to send a low pulse to the processor 23 for each revolution of the pump shaft 18. The signal processor 23 processes the signal from the ignition system 14 and the Hall switch 24 to produce a signal activating the alarm 27 if the signals from the ignition system 14 and rotation sensor 26 deviate from a predetermined pattern to indicate a failure of the oil pump drive. A level switch 28 is connected to the oil tank 20 and to the signal processor 23 to cause the signal processor 23 to activate the alarm 27 if the oil level in the tank 20 is low. The engine also includes a start switch 29 to start the engine. The start switch 29 is also connected to the signal processor 23 to activate the alarm 27 for a brief period of time when the engine is started to provide a test of the alarm system.

Figure 2:
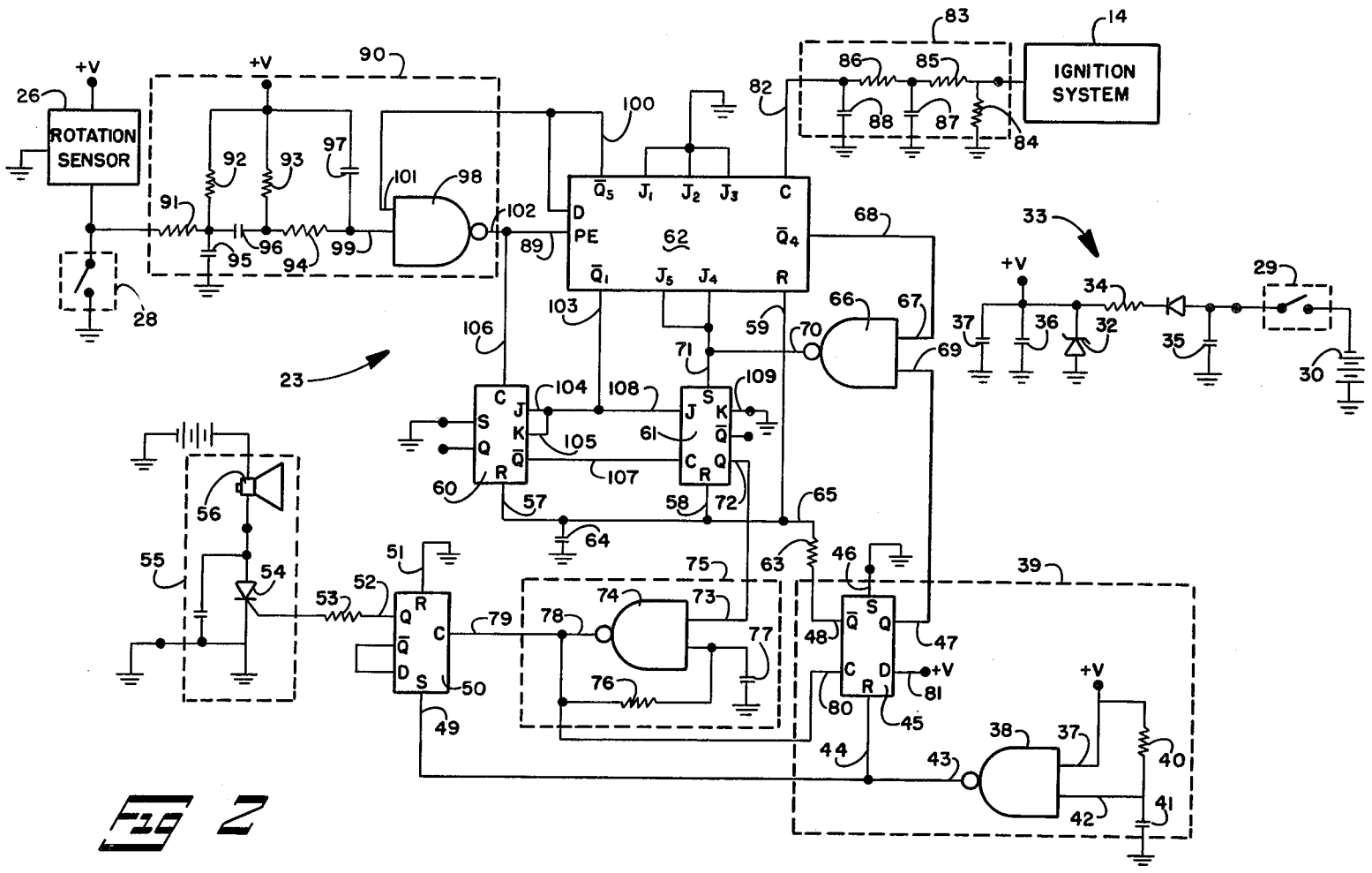
FIG. 2 is an electrical schematic diagram of the alarm system of FIG. 1.

As shown in FIG. 2, the alarm system is supplied with power from a direct current source, illustrated as a battery 30, through a key switch 29. A zener diode 32 in the regulator circuit 33 limits the voltage supplied to the signal processor 23 to a positive 6.8 volts. A resistor 34 and capacitors 34, 35, and 36 act as a filter to eliminate noise from the output of the regulator circuit 33, labeled as +v. The output of the regulator is connected to the signal processor 23 at the points labelled +v, by lines, not illustrated, to provide both power and a logical high signal. The logical low signal is provided by ground.

When the key switch 29 is turned on high logic voltage is immediately supplied to the first input 37 of the NAND gate 38 in the start-up circuit 39. The resistor 40 and capacitor 41 delay application of the high logic voltage to the second input 42 of the NAND gate 38 for a brief period of time. The output 43 of the NAND gate 38 goes high until the second input 42 goes high thus producing a start-up signal. The output of the NAND gate 38 is applied to the reset terminal 44 of the D-type flip-flop 45 in the start-up circuit 39. Since the set terminal 46 of the flip-flop 45 is connected to ground the Q output 47 will immediately go low while the Q output 48 will go high. At the same time the output of the NAND gate 38 is applied to the set terminal 49 of the D-type flip-flop 50, connected as a divider. Since its reset terminal 51 is grounded, that flip-flop 50 will have its Q output 52 go high. The Q output 52 is connected through a resistor 53 to the gate of the SCR 54 in the alarm circuit 55, thus turning on the SCR 54 to activate the warning horn 56.

During the start-up, the initial high $\overline{Q}$ output from the start up flip-flop 45 is applied to the reset terminals 57, 58 and 59 of both of the first and second JK flip-flops 60 and 61 and the counter 62, thus resetting their outputs. A resistor 63 and capacitor 64 are connected to the reset line 65 to hold the reset line 65 high during the start-up sequence. The NAND gate 66 thus initially has one high input 67 from the $\overline{Q4}$ output 68 of the counter 62 and one low input 69 from the Q output 47 of the start-up flip-flop 38, thereby applying an initial high output 70 to the set terminal 71 of the second JK flip-flop 61. The high output from the NAND gate 66 sets the Q output 72 of the second JK flip-flop 61 high thereby applying a high to a first input 73 of the NAND gate 74, connected as an oscillator 75 by a resistor 75 and capacitor 77. This turns on the oscillator 75 causing its output 78 to initially go high. The initial rise of the oscillators output 78 following the start up pulse from the NAND gate 38 is applied to the clock input 79 of the divider flip-flop 50, causing its Q output 52 to go low and turn off the alarm 56. The initial rise of the oscillator output 78 is also applied to the clock input 80 of the start-up flip-flop 45, causing its Q output 47 to go high and its $\overline{Q}$ output 48 to go low. Since the D input 81 of the start-up flip-flop 45 is held high by its connection to the +v output of the regulator circuit 33, further clock inputs will have no effect on its output. The start-up sequence is completed by the application of the high Q output 47 from the start-up flip-flop 45 to the input 69 of the NAND gate 66 causing its output 70 to go low. Since the reset terminal 58 of the second JK flip-flop 61 is held high by the capacitor 64, its Q output 72 will go low and turn off the oscillator 75, preventing further output which could activate the alarm 56.

With the start-up sequence completed, the JK flip-flops 60 and 61 and the counter 62 are reset and ready to receive inputs from the pump rotation sensor 26 and the ignition system 14. The ignition system 14 has an ignition transformer for each cylinder, like that disclosed in U.S. Pat. No. 4,306,536 to Fitzner. The clock input 82 of the counter 62 is connected to the primary coil of one of the ignition transformers by a two stage filter 83 consisting of resistors 84, 85 and 86 and capacitors 87 and 88 to attenuate and filter the 200 volt ignition spike and supply a positive 6.8 volt pulse to the clock input 82 for each revolution of the engine.

The preset terminal, PE 89, of the counter 62 is connected to the output of the Hall switch 24 in the pump rotation sensor 26 by a pulse shaping network 90 including resistors 91, 92, 93 and 94, capacitors 95, 96, and 97, and a NAND gate 98. The junction between the resistors 92 and 93 and the capacitor 97 is connected to the 6.8 volt power supply to supply a logical high to one input 99 of the NAND gate 98 except for a brief period when the Hall switch 24 is activated by the magnet 25 on the pump shaft 18 to connect the pulse shaping network 90 to ground. When the Hall switch 24 is initially activated the capaitor 96 is discharged to ground, but is subsequently recharged through the resistor 93, even if the Hall switch 24 remains activated. Thus a series of logical low pulses are supplied to the input 99 of the NAND gate 98, one pulse for each revolution of the pump shaft 18. Since the $\overline{Q5}$ output 100 of the counter 62 has been reset to produce a high output which is supplied to the other input 101 of the NAND gate 98, the NAND gate 98 will have a low output 102 except when the low pulse from the pump rotation sensor 26 is present. Thus the NAND gate 98 supplies a positive pulse to the preset terminal 89 of the counter 62 for every revolution of the pump shaft 18.

In normal operation the counter 62 will count two clock pulses from the ignition circuit 14, causing the $\overline{Q1}$ output 103 and the $\overline{Q2}$ output, not illustrated, to go low, and then the counter 62 will be preset by the pulse from the pump rotation sensor 26. Thus the $\overline{Q4}$ output 68 will normally be maintained high, preventing setting of the second JK flip-flop 61 by the NAND gate 66 which would activate the alarm 56. The $\overline{Q4}$ output 68 is used as the alarm output, rather than the $\overline{Q3}$ output, to allow the counter 62 to count a third clock pulse before activating the alarm 56. This is necessary because changes in the engines ignition timing, i.e. spark advance or retard, could cause a third clock pulse to arrive at the counter 62 before the arrival of the preset pulse. With the arrival of the preset pulse, all of the $\overline{Q}$ outputs of the counter will be set high, since the J1, J2, and J3 inputs are held low by their connection to ground the the J4 and J5 inputs are held low by the output of the NAND gate 66.

When the engine is started either a pulse from the rotation sensor 26 or a pulse from the ignition circuit 14 will be received first. If an ignition pulse is received first, the $\overline{Q1}$ output 103 of the counter 62 will go low, thus holding the J and K inputs 104 and 105 of the first JK flip-flop 60 low. Thus a subsequent pulse from the rotation sensor 26 applied to the clock input 106 of the first JK flip-flop 60 will have no effect on the $\overline{Q}$ output 107 of the first JK flip-flop 60, that is, it will remain high. If the rotation sensor pulse is received first, the first JK flip-flop 60 will have its Q output 107 go low, since its J and K inputs 104 and 105 will still be held high by the $\overline{Q1}$ output 103 of the counter 62. This will have no effect on the second JK flip-flop 61, however, because it is only clocked by a positive going pulse from the $\overline{Q}$ output 107 of the first JK flip-flop 60. In either case, the counter 62 will subsequently continue to count the pulses from the ignition circuit 14 and be preset by the pulse from the rotation sensor 26 with no further change in the output of either of the JK flip-flops 60 and 61.

Now, should the counter 62 fail to receive its appropriately timed preset pulses indicating an alarm condition, either because of a failure of the oil pump drive or because the oil in the oil reservoir 20 has reached a low enough level to close the float switch 28 and ground the pulse shaping network 90, the counter 62 will continue to count the pulses from the ignition circuit 14 until the $\overline{Q4}$ output 68 goes low. It is noted that should the float switch 28 ground, the pulse shaping network 90 or should the oil pump 19 fail in a position activating the Hall switch 24, the capacitor 96 will recharge, eliminating the preset signal. At this point the output of the NAND gate 66 will go high and set the second JK flip-flop 61 causing is Q output 72 to go high and turn on the oscillator circuit 75, thereby activating the alarm 56. Subsequent pulses applied to the preset terminal 89 of the counter 62 will not turn off the alarm 56, since the output 70 of the NAND gate 66 is also applied to the J4 and J5 terminals of the counter 62, causing the $\overline{Q4}$ and $\overline{Q5}$ outputs 68 and 100 to go low when preset. With the $\overline{Q5}$ output 100 holding one of the inputs 101 to the NAND gate 98 low, the output 102 of the NAND gate 98 will continue to hold the preset terminal 89 of the counter 62 high, preventing further preset signals from reaching the counter 62. Thus the alarm 56 will continue to operate until the start switch 29 is turned off.

Another alarm condition arises if the pulses from the ignition system 14 fail to arrive at the counter 62, indicating a failure of the alarm system. In this case the $\overline{Q1}$ output 103 of the counter 62 will remain high, holding the J and K inputs 104 and 105 of the first JK flip-flop 60 high along with the J input 108 of the second JK flip-flop 61. Thus the first JK flip-flop 60 changes its output state with each pulse from the pump rotation sensor 26 and its $\overline{Q}$ output 107 will provide a clock pulse to the second JK flip-flop 61. With the J input 108 of the second JK flip-flop 61 held high by the counter 62, and the K input 109 held low by its connection to ground, the Q output 72 of the second JK flip-flop 61 will go high upon receiving a clock pulse from the first JK flip-flop 60 and remain high through subsequent clock pulses. Thus the oscillator 75 and alarm 56 will be turned on and remain on until the starter switch 29 is turned off. Subsequent pulses from the ignition circuit 14 will not turn off the alarm 56 since their receipt by the counter 62 will cause the $\overline{Q1}$ output 103 to go low and hold the J and K terminals 104 and 105 of the first JK flip-flop 60 low, preventing the first JK flip-flop 60 from supplying clock pulses to the second JK flip-flop 61.

I claim:

1. An alarm system for a two-cycle internal combustion engine using a mechanically driven oil pump to provide oil from an oil reservoir to said engine for engine lubrication, said alarm system comprising:

(A) an alarm means;

(B) a means to sense the operation of said oil pump and provide a signal indicative of the speed of operation of said pump;

(C) a means to sense to operation of said engine and provide a signal indicative of the speed of operation of said engine; and (D) a signal processing means connected to receive said pump signal and said engine signal and produce an alarm signal to activate said alarm if said pump and engine signals differ from a predetermined relationship.

2. The alarm system defined in claim 1 further comprising an engine starting switch to provide a starting signal when said switch is turned on, and said signal processing means is connected to receive said starting signal and includes means to produce a test signal to actuate said alarm for a fixed period of time when said switch is turned on.

3. The alarm system defined in claim 2 wherein said signal processing means includes means to continue the activation of said alarm, when said alarm signal is received, until said starting switch is turned off.

4. The alarm system defined in claim 3 further comprising an oil level sensor to sense the level of oil in said reservoir and produce a signal indicating a low oil level in said reservoir and said signal processing means is connected to receive said low oil level signal and includes means to produce said alarm signal when said low oil level signal is provided.

5. An alarm system for a two-cycle internal combustion engine having an output shaft and an oil pump to provide oil from a reservoir to said engine, said oil pump driven by a pump shaft, said pump shaft driven by said output shaft at a fixed speed ratio to the speed of said output shaft, said alarm system comprising:

(A) an alarm means;

(B) a rotation sensor coupled to said pump shaft to produce a pump output pulse for every revolution of said pump shaft;

(C) an engine speed sensor to produce an engine output pulse from every revolution of said output shaft; and (D) a sequential logic circuit connected to receive said output pulses and produce an alarm signal to activate said alarm if said output pulses differ from a predetermined sequential relationship.

6. The alarm system defined in claim 5 wherein said rotation sensor includes a magnet mounted on said pump shaft and a Hall switch mounted on said engine adjacent said pump shaft to produce said pump output pulse when one pole of said magnet passes said Hall switch.

7. The alarm system defined in claim 5 wherein said engine includes an electrical circuit for providing an operating pulse for each revolution of said engine to provide an engine operating function and wherein said engine speed sensor is connected to said electrical circuit to produce said engine output pulse.

8. The alarm system defined in claim 5 further comprising an oil level sensor to sense the level of oil in said reservoir, said oil level sensor including a switch which operates when the level of oil in said reservoir is low to interrupt said pump output pulse from said rotation sensor.

9. The alarm system defined in claim 5 wherein said sequential logic circuit includes an oscillator to make said alarm signal intermittent.

10. The alarm system defined in claim 9 wherein said engine includes an engine starting switch to start said engine and supply power to said alarm system and wherein said alarm system includes means to supply a starting signal to said logic circuit when power is initailly received from said starting switch and said logic circuit includes means to produce a test signal to activate said alarm for a fixed period of time in response to said test signal.

* * * * *